US007861320B1

(12) United States Patent
Leese

(10) Patent No.: US 7,861,320 B1
(45) Date of Patent: Jan. 4, 2011

(54) TIE FORM SYSTEM

(76) Inventor: Jay M. Leese, 1543 W. School St., Chicago, IL (US) 60657

( * ) Notice: Subject to any disclaimer, the term of this patent is extended or adjusted under 35 U.S.C. 154(b) by 0 days.

(21) Appl. No.: 11/954,555

(22) Filed: Dec. 12, 2007

(51) Int. Cl.
*A41D 25/08* (2006.01)

(52) U.S. Cl. ..... 2/152.1

(58) Field of Classification Search ..... 2/144–150, 2/152.1, 153–156
See application file for complete search history.

(56) References Cited

U.S. PATENT DOCUMENTS 2,148,582 A 2/1939 Rodgers
2,628,360 A 2/1953 Kush
3,964,105 A 6/1976 Gideon
4,573,219 A 3/1986 Hooten
5,216,757 A 6/1993 Dorkin
5,390,370 A * 2/1995 Koy ..... 2/153
5,416,926 A * 5/1995 Koy ..... 2/153
5,577,778 A 11/1996 Parietti et al.

* cited by examiner

*Primary Examiner*—Tejash Patel

(57) ABSTRACT

A tie form system includes a necktie that is elongated and has a first end and a second end. A housing has a top wall, a bottom wall, a front wall, a rear wall, a first lateral wall and a second lateral wall. The front wall is angled toward the rear wall from the top wall to the bottom wall and the top wall has a greater width than the bottom wall. The first and second lateral walls taper toward each other from the top wall to the bottom wall and the top wall has a greater length than the bottom wall. A loop is coupled to the rear wall of the housing. The first end of the necktie is extended through loop and the necktie tied around the housing so that the necktie conforms to a shape of the housing.

11 Claims, 3 Drawing Sheets

TIE FORM SYSTEM

BACKGROUND OF THE INVENTION

Field of the Invention

The present invention relates to tie form devices and more particularly pertains to a new tie form device for assisting a person, while they tie a knot in a tie, to form the knot in a correct shape.

SUMMARY OF THE INVENTION

The present invention generally comprises a necktie that is elongated and has a first end and a second end. A housing has a top wall, a bottom wall, a front wall, a rear wall, a first lateral wall and a second lateral wall. The housing has a height dimension from the bottom wall to the top wall, a length dimension from the first lateral wall to the second lateral wall and a width dimension from the front wall to the rear wall. The front wall is angled toward the rear wall from the top wall to the bottom wall and the top wall has a greater width than the bottom wall. The first and second lateral walls taper toward each other from the top wall to the bottom wall and the top wall has a greater length than the bottom wall. A loop is coupled to the rear wall of the housing. The first end of the necktie is extended through loop and the necktie tied around the housing so that the necktie conforms to a shape of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
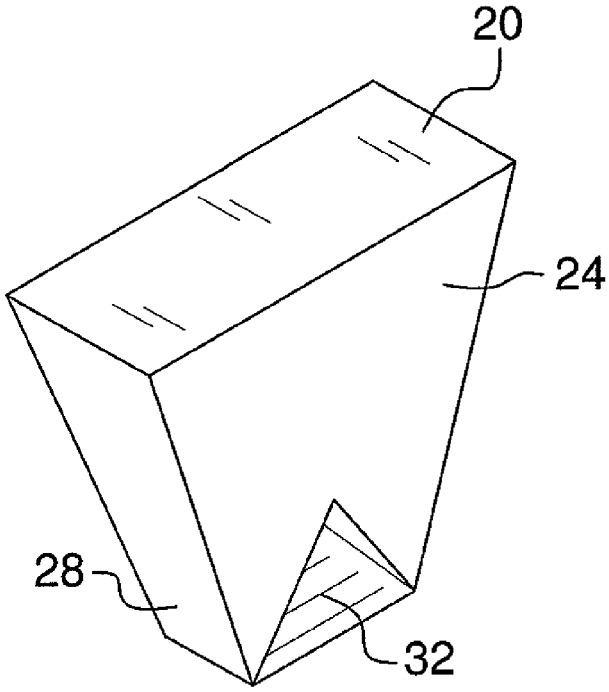
FIG. 1 is a perspective front view of a tie form system according to the present invention.
Figure 2:
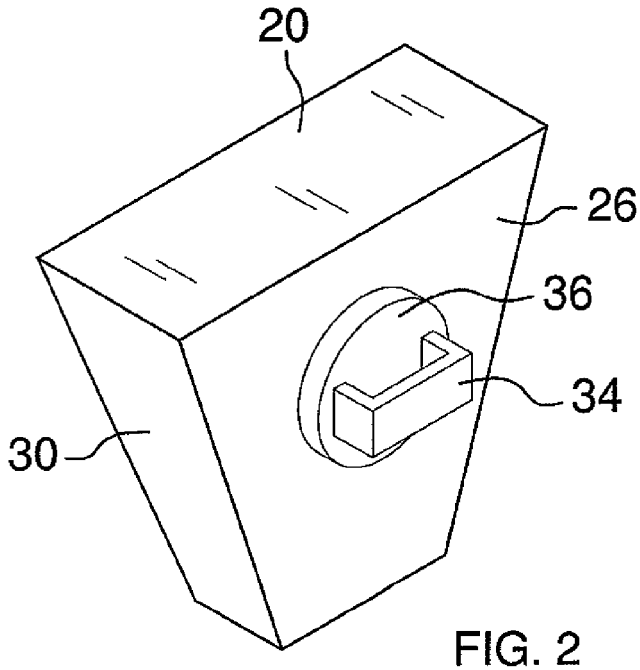
FIG. 2 is a perspective back view of the present invention.
Figure 3:
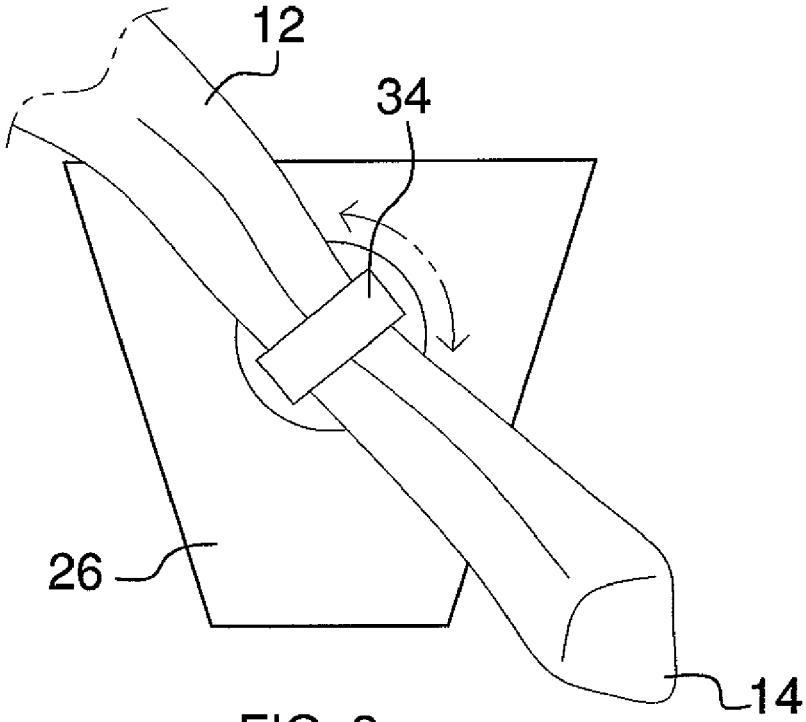
FIG. 3 is a back view of the present invention.
Figure 4:
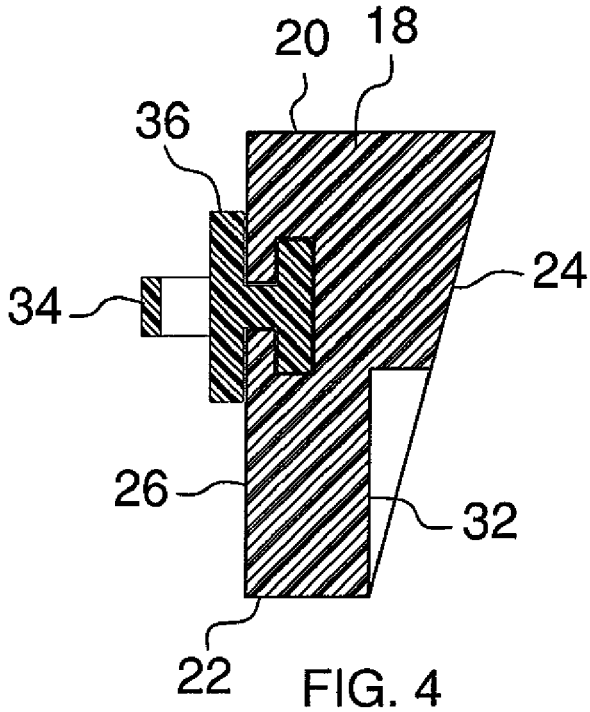
FIG. 4 is a cross-sectional view of the present invention taken along line 4-4 of FIG. 2.
Figure 5:
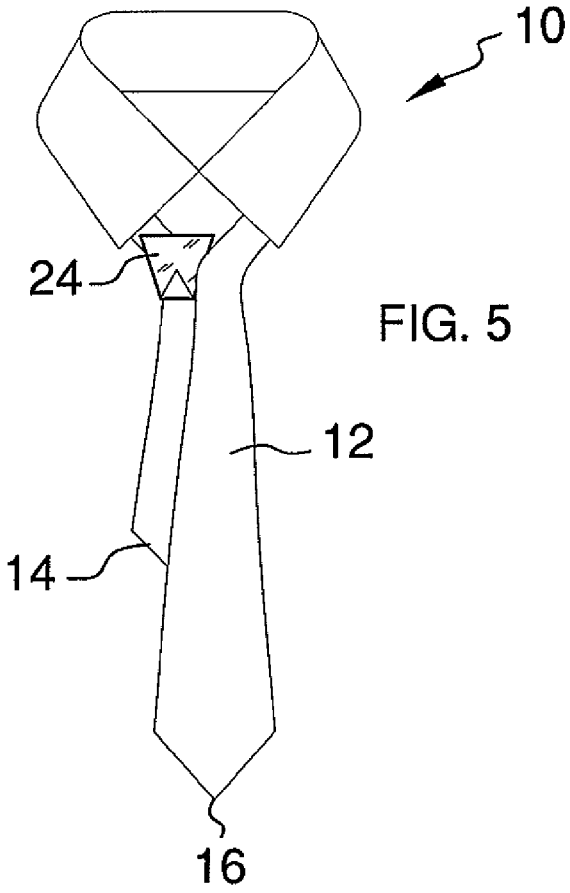
FIG. 5 is a front view of the present invention.
Figure 6:
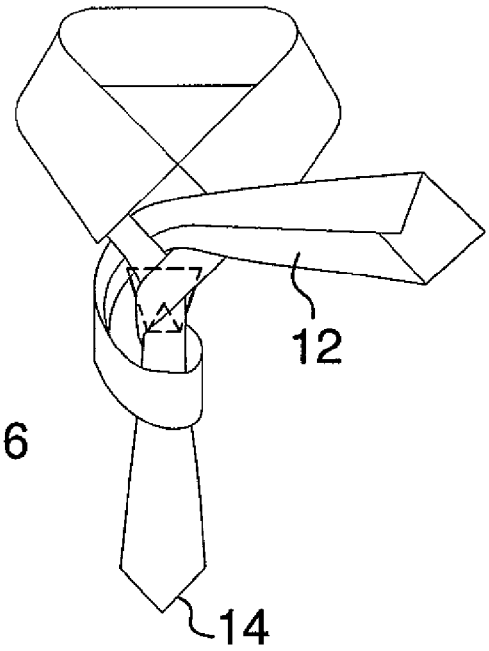
FIG. 6 is a front view of the present invention.

With reference now to the drawings, and in particular to FIGS. 1 through 6 thereof, a new tie form device embodying the principles and concepts of the present invention and generally designated by the reference numeral 10 will be described.

As best illustrated in FIGS. 1 through 6, the tie form system 10 generally comprises a conventional necktie 12 that is elongated and has a first end 14 and a second end 16.

A housing 18 has a top wall 20, a bottom wall 22, a front wall 24, a rear wall 26, a first lateral wall 28 and a second lateral wall 30. The housing 18 has a height dimension from the bottom wall 22 to the top wall 20, a length dimension from the first lateral wall 28 to the second lateral wall 30 and a width dimension from the front wall 24 to the rear wall 26. The front wall 24 is angled toward the rear wall 26 from the top wall 20 to the bottom wall 22 and the top wall 20 has a greater width than the bottom wall 22. The first 28 and second 30 lateral walls taper toward each other from the top wall 20 to the bottom wall 22 and the top wall 20 has a greater length than the bottom wall 22. The front wall 24 has a notch 32 therein positioned adjacent to the bottom wall 33. The notch 32 is coextensive with a juncture of the bottom 22 and front 24 walls and is triangular shaped. The rear wall 26 has a height approximately equal to 1 inch and is oriented perpendicular to the top 20 and bottom 22 walls. The top wall 20 has a length approximately equal to about 1 inch and a width approximately between 1 inch and ½ inch.

A loop 34 is coupled to the rear wall 26 of the housing 18. The first end 14 of the necktie 12 is extended through loop 34 and the necktie 12 tied around the housing 18 so that the necktie 12 conforms to a shape of the housing 18. A plate 36 is rotatably coupled to the rear wall 26. The plate 36 lies in a plane oriented parallel to a plane of the rear wall 26. The loop 34 is positioned on the plate 36.

In use, the necktie 12 is extended through the loop 34 and tied in a conventional manner and the bottom of the knot is slid into the notch 32. The shape of the housing 18 conforms to the classic shape of a Windsor knot. This ensures that the edges of the knot are straight and crisp and the plate 36 allows the knot in the necktie 18 to be easily adjusted with respect to the wearer of the necktie 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tie form system comprising:

a necktie being elongated and having a first end and a second end;

a housing having a top wall, a bottom wall, a front wall, a rear wall, a first lateral wall and a second lateral wall, said housing having a height dimension from said bottom wall to said top wall, a length dimension from said first lateral wall to said second lateral wall and a width dimension from said front wall to said rear wall, said front wall being angled toward said rear wall from said top wall to said bottom wall and said top wall having a greater width than said bottom wall, said first and second lateral walls tapering toward each other from said top wall to said bottom wall and said top wall having a greater length than said bottom wall;

a plate being rotatable coupled to said rear wall, said plate lying in a plane oriented parallel to a plane of said rear wall, said loop being positioned on said plate; and a loop being coupled to said plate, said first end of said necktie being extended through loop and said necktie tied around said housing, said necktie conforming to a shape of said housing.

2. The system according to claim 1, wherein said front wall has a notch therein positioned adjacent to said bottom wall.

3. The system according to claim 2, wherein said notch is coextensive with a juncture of said bottom and front walls and is triangular shaped.

4. The system according to claim 3, wherein said rear wall has a height approximately equal to 1 inch, said top wall having a length approximately equal to about 1 inch, said top wall having a width approximately between 1 inch and ½ inch.

5. The system according to claim 1, wherein said rear wall has a height approximately equal to 1 inch, said top wall having a length approximately equal to about 1 inch, said top wall having a width approximately between 1 inch and ½ inch.

6. A tie form system comprising:

a necktie being elongated and having a first end and a second end;

a housing having a top wall, a bottom wall, a front wall, a rear wall, a first lateral wall and a second lateral wall, said housing having a height dimension from said bottom wall to said top wall, a length dimension from said first lateral wall to said second lateral wall and a width dimension from said front wall to said rear wall, said front wall being angled toward said rear wall from said top wall to said bottom wall and said top wall having a greater width than said bottom wall, said first and second lateral walls tapering toward each other from said top wall to said bottom wall and said top wall having a greater length than said bottom wall, said front wall having a notch therein positioned adjacent to said bottom wall, said notch being coextensive with a juncture of said bottom and front walls and being triangular shaped, said rear wall having a height approximately equal to 1 inch, said top wall having a length approximately equal to about 1 inch, said top wall having a width approximately between 1 inch and ½ inch;

a loop being coupled to said rear wall of said housing, said first end of said necktie being extended through loop and said necktie tied around said housing, said necktie conforming to a shape of said housing; and a plate being rotatably coupled to said rear wall, said plate lying in a plane oriented parallel to a plane of said rear wall, said loop being positioned on said plate.

7. A tie form apparatus for assisting a person in properly tying an elongated necktie having a first end and a second end, said apparatus comprising:

a housing having a top wall, a bottom wall, a front wall, a rear wall, a first lateral wall and a second lateral wall, said housing having a height dimension from said bottom wall to said top wall, a length dimension from said first lateral wall to said second lateral wall and a width dimension from said front wall to said rear wall, said front wall being angled toward said rear wall from said top wall to said bottom wall and said top wall having a greater width than said bottom wall, said first and second lateral walls tapering toward each other from said top wall to said bottom wall and said top wall having a greater length than said bottom wall;

a plate being rotatably coupled to said rear wall, said plate lying in a plane oriented parallel to a plane of said rear wall, said loop being positioned on said plate; and a loop being coupled to said plate, the first end of the necktie is extendable through loop and the necktie being conformable to a shape of said housing when the necktie is tied around said housing.

8. The system according to claim 7, wherein said front wall has a notch therein positioned adjacent to said bottom wall.

9. The system according to claim 8, wherein said notch is coextensive with a juncture of said bottom and front walls and is triangular shaped.

10. The system according to claim 9, wherein said rear wall has a height approximately equal to 1 inch, said top wall having a length approximately equal to about 1 inch, said top wall having a width approximately between 1 inch and ½ inch.

11. The system according to claim 7, wherein said rear wall has a height approximately equal to 1 inch, said top wall having a length approximately equal to about 1 inch, said top wall having a width approximately between 1 inch and ½ inch.

* * * * *